US010981709B2

(12) United States Patent
Stefani

(10) Patent No.: US 10,981,709 B2
(45) Date of Patent: Apr. 20, 2021

(54) PACK OF TISSUE PAPER ROLLS WRAPPED IN A PLASTIC FILM

(71) Applicant: SOFIDEL S.P.A., Porcari (IT)

(72) Inventor: Emi Stefani, Porcari (IT)

(73) Assignee: SOFIDEL S.P.A., Porcari (IT)

( * ) Notice: Subject to any disclaimer, the term of this patent is extended or adjusted under 35 U.S.C. 154(b) by 0 days.

(21) Appl. No.: 16/332,141

(22) PCT Filed: Sep. 5, 2017

(86) PCT No.: PCT/EP2017/072190

§ 371 (c)(1),
(2) Date: Mar. 11, 2019

(87) PCT Pub. No.: WO2018/046476

PCT Pub. Date: Mar. 15, 2018

(65) Prior Publication Data

US 2019/0210783 A1 Jul. 11, 2019

(30) Foreign Application Priority Data

Sep. 12, 2016 (IT) ..... 102016000091699

(51) Int. Cl.
*B65D 75/66* (2006.01)
*B65D 85/08* (2006.01)
*B65D 85/07* (2017.01)

(52) U.S. Cl.
CPC ..... *B65D 75/66* (2013.01); *B65D 85/07* (2018.01); *B65D 85/08* (2013.01)

(58) Field of Classification Search
CPC ..... B65D 75/66; B65D 27/38; B65D 5/5432–544; B65D 85/07–08
(Continued)

(56) References Cited

U.S. PATENT DOCUMENTS 2,141,252 A 12/1938 Prindle
2,315,116 A * 3/1943 Flizikowski ..... B65D 75/68 229/238
(Continued)

FOREIGN PATENT DOCUMENTS

EP 0 454 541 A1 10/1991
EP 0454541 A1 * 10/1991 ..... B65D 75/56
(Continued)

OTHER PUBLICATIONS

EP 0454541 Machine Translation (Year: 1991).*

*Primary Examiner* — Christopher R Demeree
*Assistant Examiner* — Phillip D Schmidt
(74) *Attorney, Agent, or Firm* — McGlew and Tuttle, P.C.

(57) ABSTRACT

The pack (10) of tissue paper rolls comprises a plurality of rolls (R) of tissue paper that are arranged adjacent to one another with the respective axes parallel to, or coinciding with, one another, and are wrapped in a plastic film (1). The plastic film (1) laterally wraps the rolls (R) and is arranged with a first and a second longitudinal edge (1.1; 1.2) folded and closed onto two approximately flat opposite surfaces (11, 13), which are defined by bases of the tissue paper rolls. The plastic film (1) comprises a first transverse edge (1.3) and a second transverse edge (1.4) extending from one flat surface to the other. One of said transverse edges is outside the pack and the other is inside the pack. A line-shaped element (3), having a first end and a second end (3A, 3B), is applied to a surface of the plastic film (1). At least one of the ends of the line-shaped element (3) is arranged near, or in correspondence of, the transverse edge (1.4) of the plastic film (1) outside the pack (10).

26 Claims, 2 Drawing Sheets

(58) Field of Classification Search
USPC ..... 229/87.05, 123.2, 239
See application file for complete search history.

(56) References Cited

U.S. PATENT DOCUMENTS

| | | | | |
|---|---|---|---|---|
| 5,411,202 | A * | 5/1995 | Fenini | B65D 75/68 229/87.05 |
| 2006/0054676 | A1* | 3/2006 | Wischusen, III | B65D 5/5445 229/235 |
| 2018/0118407 | A1* | 5/2018 | Nash | C09J 7/20 |

FOREIGN PATENT DOCUMENTS

| | | | | |
|---|---|---|---|---|
| EP | 2 030 911 | A1 | 3/2009 | |
| EP | 2030911 | A1 * | 3/2009 | B65D 75/68 |
| WO | 03/072455 | A1 | 9/2003 | |
| WO | WO-03072455 | A1 * | 9/2003 | B65D 75/66 |

* cited by examiner

Fig.1
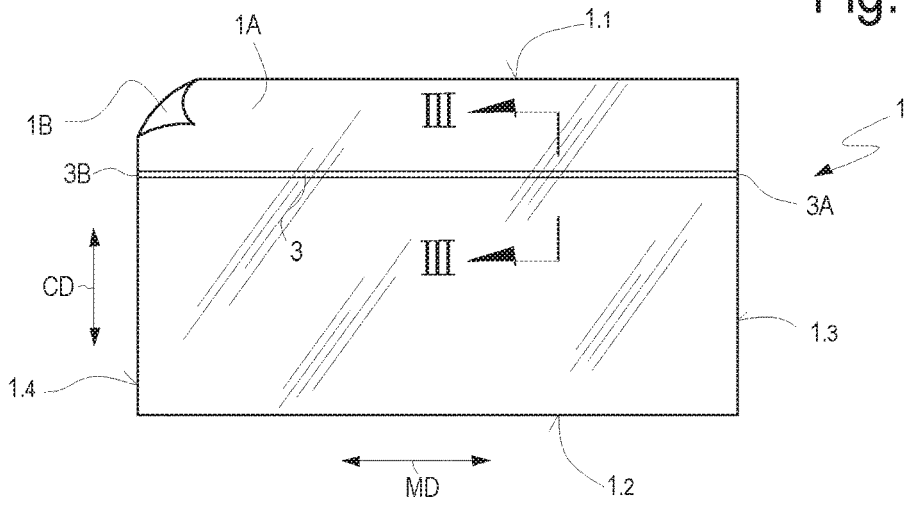
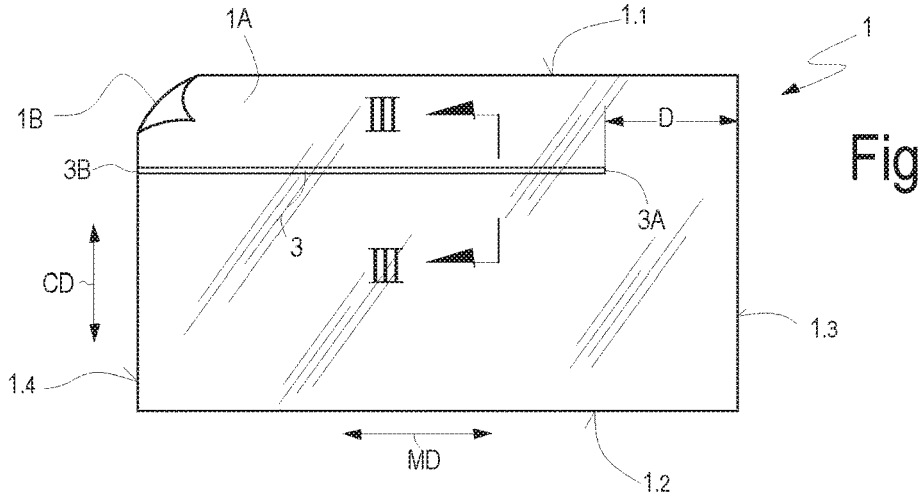
Fig.2
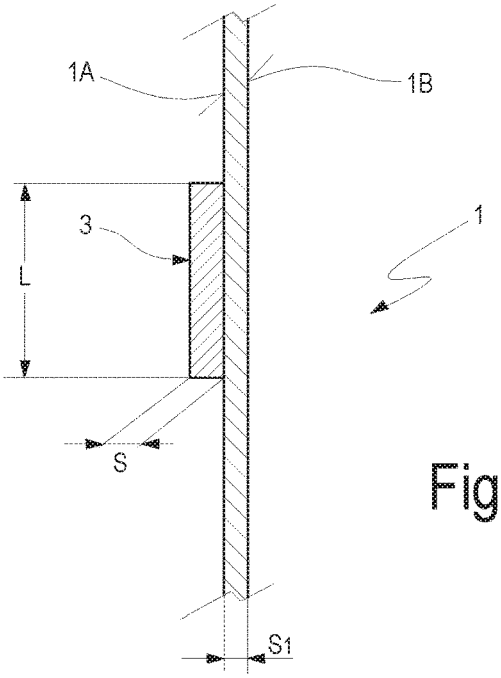
Fig.3

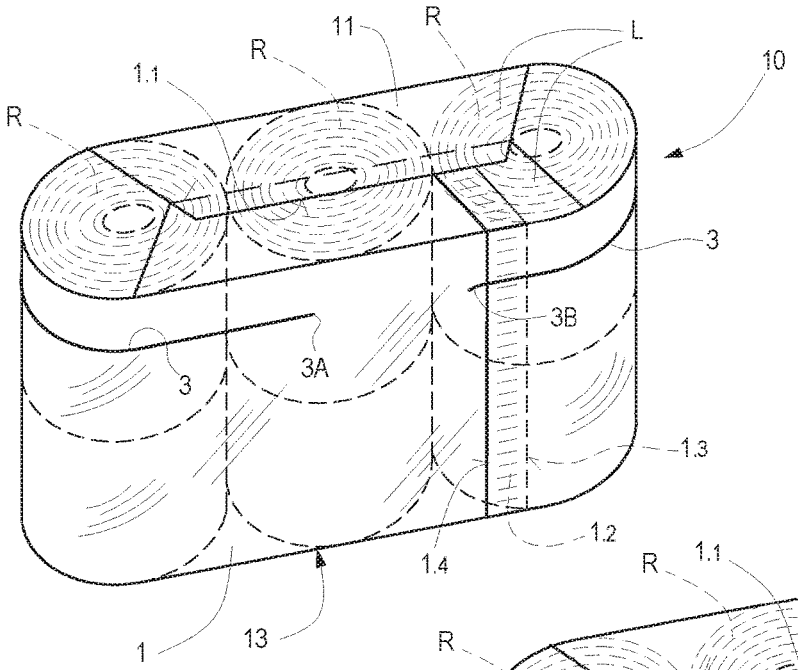
Fig.4
Fig.5
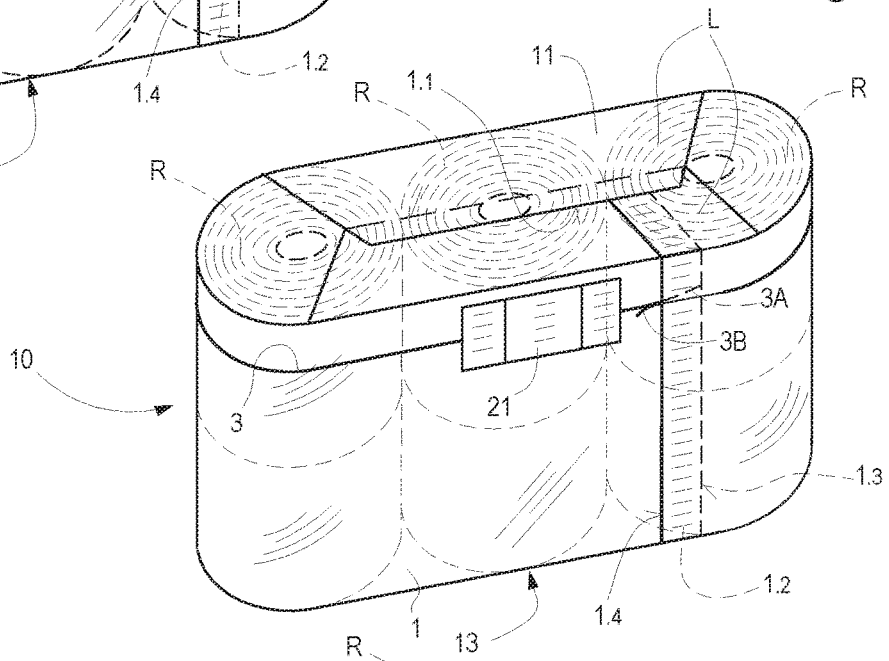
Fig.6
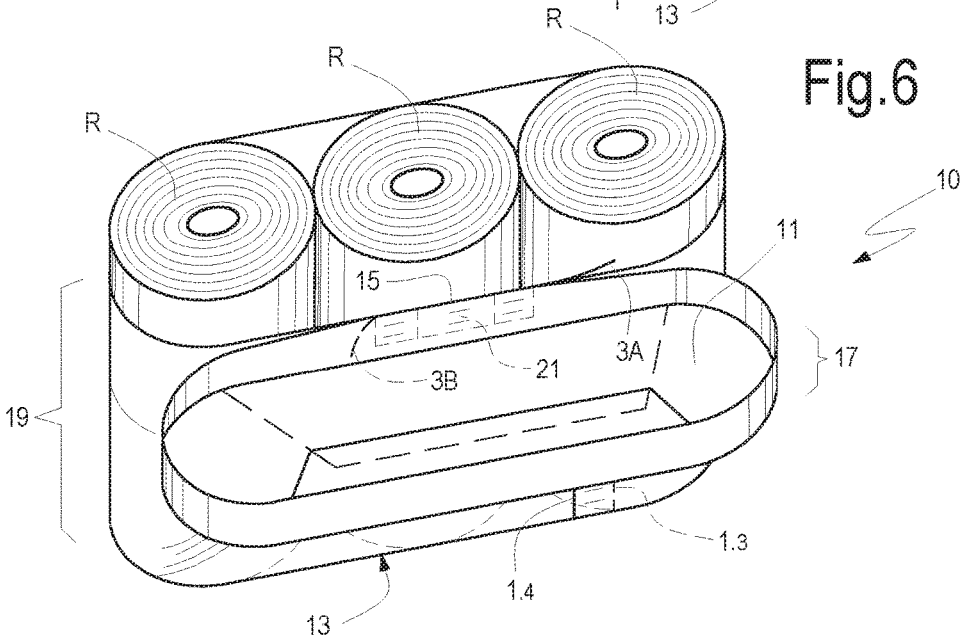

PACK OF TISSUE PAPER ROLLS WRAPPED IN A PLASTIC FILM

TECHNICAL FIELD

The present invention relates to improvements to packs of tissue paper rolls, for example toilet paper, kitchen towels and the like.

BACKGROUND TO THE INVENTION

Tissue paper rolls, such as toilet paper rolls, kitchen towels rolls and the like, are often wrapped in a plastic film, made for example of polypropylene, polyethylene and the like. The film is wrapped around a group of rolls arranged in rows and layers. The film edges are folded and welded to close the pack.

The pack can even contain a high number of rolls, from six to twenty-four. The rolls are ordered in two or more overlying layers, each of which comprises a plurality of adjacent rolls. The rolls are arranged with the respective axes parallel to one another, and the pack has two approximately flat opposite surfaces, onto which the edges of the plastic film are folded and welded.

Opening these packs can be difficult. Once the plastic film has been torn and the first roll has been taken from the pack, the remaining rolls have no longer protection.

A need therefore exists to provide packs of tissue paper rolls of the type described above, that partially or completely overcome the drawbacks of the known packs.

SUMMARY

In order to solve or alleviate the problems of the prior art packs, a pack of tissue paper rolls is provided, comprising a plurality of tissue paper rolls adjacent to one another and wrapped in a plastic film that is closed for instance by means of welding. The plastic film laterally wraps the rolls and is arranged with a first longitudinal edge and a second longitudinal edge folded and closed, for example welded, onto two approximately flat opposite surfaces, which are defined by bases of the tissue paper rolls. Moreover, the plastic film comprises a first transverse edge and a second transverse edge extending from one flat surface to the other, one of the first transverse edge and second transverse edge being outside the pack and the other transverse edge being inside the pack. A line-shaped element, having at least one end near, or at the transverse edge of the plastic film outside the pack, is applied to a surface of the plastic film facing preferably the inside of the pack. By gripping this end of the line-shaped element it is possible to tear the plastic film wrapping the rolls, thus facilitating opening the pack.

Further features and embodiments will be described below with reference to exemplary embodiments of the inventions, and in the attached claims, that form an integral part of the present description.

BRIEF DESCRIPTION OF THE DRAWING

The invention will be better understood by following the description and the accompanying drawings, which show non-limiting practical embodiments of the invention. More particularly, in the drawings:

FIG. 1 shows a plastic film for a pack according to the present disclosure, in a first embodiment;

FIG. 2 shows a plastic film similar to that of FIG. 1 in a second embodiment;

FIG. 3 shows a schematic enlargement of the section according to III-III of FIGS. 1 and 2;

FIGS. 4 and 5 show axonometric views of two packs in two embodiments; and FIG. 6 shows an open pack.

DETAILED DESCRIPTION OF EMBODIMENTS

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments FIGS. 1 and 2 show a plastic film usable for making a pack according to the present disclosure. The film, indicated as a whole with reference number 1, may be made of polypropylene, polyester, polyethylene and paper.

The plastic film 1 has a longitudinal dimension MD and a cross dimension CD. Reference numbers 1.1 and 1.2 designate the two longitudinal edges of the plastic film 1, and the reference numbers 1.3 and 1.4 designate the two transverse edges of the plastic film 1. The plastic film 1 may be obtained from a reel of plastic film produced continuously. The longitudinal direction MD may be the direction parallel to the film winding direction in the reel, corresponding to the machine direction, along which the film has been produced during the extrusion process. In this case, the direction CD is the cross direction, i.e. the direction orthogonal to the machine direction MD.

The plastic film 1 has a first surface 1A and a second surface 1B. A line-shaped element 3 is applied to the surface 1A of the plastic film 1, which will face the inside of the pack. The line-shaped element 3 may be constituted by a strip of polymer material, for example PVC, polypropylene, polyamide, polyethylene or polyester.

In some embodiments, the line-shaped element 3 may be arranged so that, in the final pack, it is on a plane approximately orthogonal to the axes of the rolls contained in the pack.

In this context, the term "line-shaped" indicates an element having a longitudinal dimension substantially larger than the cross dimension, in particular, for example, by at least two orders of magnitude with respect to the maximum cross dimension. The maximum cross dimension is, in general, the width, which is in turn by one or more orders of magnitude larger than the thickness.

The line-shaped element 3 may be made of a plastic film, i.e. a polymer film. It can be constituted by a thin and long strip of width comprised between 1 and 3 mm, for instance. The thickness of the polymer film forming the line-shaped element 3 may be smaller than the width of the strip forming the line-shaped element 3 by approximately two orders of magnitude. The line-shaped element 3 may have, for example, a thickness comprised between 15 and 50 micrometers, preferably between 20 and 40 micrometers.

In the embodiment of FIG. 1, the line-shaped element 3 has a length equal to the longitudinal dimension of the plastic film 1 and is applied parallel to the longitudinal edges 1.1 and 1.2 of the plastic film 1.

In some modified embodiments, as shown in FIG. 2, the line-shaped element 3 may have a length smaller than the longitudinal dimension of the plastic film 1. In the embodiment of FIG. 1 the line-shaped element 3 has a first end 3A and a second end 3B that are arranged respectively at the transverse edges 1.3 and 1.4. Vice versa, in the embodiment of FIG. 2, only the end 3B of the line-shaped element 3 is at a transverse edge of the plastic film 1, particularly at the transverse edge 1.4, whilst the end 3A of the line-shaped element 3 is spaced from the transverse edge 1.3 by a distance D, for the purposes described below.

FIG. 3 shows an enlarged cross section of the plastic film 1 according to III-III of FIG. 1 and FIG. 2. The section is not scaled for the sake of clarity of representation. Even if not scaled, FIG. 3 shows that the line-shaped element 3 may have a width L larger than the thickness S. The thickness S of the line-shaped element 3 may be approximately of the same order of magnitude as the thickness S1 of the plastic film 1.

The line-shaped element 3 may be applied to the surface 1A of the plastic film 1 by means of gluing, for example with a pressure-sensitive adhesive. In some embodiments, the line-shaped element 3 may be applied to the surface 1A of the plastic film 1 with an adhesive based on one or more of the following polymers: acrylic, nitrile, vinyl-ether, EVA, SBS, SEBS, SIP, SIS, butyl rubber, natural rubber, silicone rubber.

In the configuration of FIG. 1 or in that of FIG. 2, the plastic film 1 may be used to form a pack of tissue paper rolls, as shown in FIG. 4. In this figure, the plastic film 1 of FIG. 2 is used, wherein the line-shaped element 3 has a length smaller than the longitudinal dimension of the plastic film 1.

In this embodiment, the pack, labeled 10 as a whole, contains an arrangement of six tissue paper rolls R arranged on three rows, each of which comprises two rolls. It will be clearly apparent to those skilled in the art that the number and arrangement of the rolls may vary also significantly with respect to what illustrated in FIG. 4 just by way of non-limiting example. The pack 10 may comprise, for instance, two or three overlying layers of rolls, each of which is formed by a matrix arrangement, for example 2×3=6 rolls.

The plastic film 1 is wrapped around the ordered group of rolls R so as to wrap the side surface of the pack, surrounding the rolls cylindrical surfaces. The cross dimension of the plastic film 1 is such that it projects at two sides with respect to the flat surfaces of the rolls R. The two portions of plastic film 1 projecting with respect to the bases of the rolls R form edges L, which are folded and sealed onto the two approximately flat opposite surfaces 11, 13 of the pack.

The transverse edges 1.3, 1.4 of the plastic film 1 are arranged on the side surface of the pack and extend from one approximately flat surface of the pack to the other. In the illustrated example, the transverse edge 1.4 of the plastic film 1 is outside the pack, whilst the transverse edge 1.3 is inside the pack. A welding line closing the pack 10 is provided between the two transverse edges 1.4 and 1.3. The welding line, schematically indicated with 12, preferably extends parallel to the transverse edges 1.4 and 1.3 and is spaced from the outer transverse edge 1.4 for example by a distance comprised between 5 mm and 30 mm. The outer transverse edge 1.4 can be therefore easily gripped by the user to open the pack as described below.

The folded edges of the plastic film 1 are welded in order to close the pack in the area of the longitudinal edges 1.1 e 1.2. The pack can also be closed by means of gluing.

The end 3A of the line-shaped element 3 is arranged inside the pack 10, while the end 3B is arranged on the transverse edge 1.4 of the plastic film 1 and can be accessed from the outside.

In order to easily open the pack 10, the user can grip the end 3B of the line-shaped element 3 and pull it, moving it away from the pack 10. As the welding line 12 has been made at a certain distance from the transverse edge 1.4, the end 3B of the line-shaped element 3 can be gripped more easily by the user.

By pulling the line-shaped element 3 towards the outside, the plastic film 1 tears along the line-shaped element 3.

FIG. 6 shows the pack 10 in open arrangement, after the plastic film 1 has been torn through the action of the line-shaped element 3. Thanks to the fact that the end 3A of the line-shaped element 3 is provided in intermediate position with respect to the longitudinal extension of the plastic film 1, at a distance D from the transverse edge 1.3 (FIG. 2), not the whole plastic film 1 is broken along the line defined by the line-shaped element 3; namely a portion thereof, indicated with number 15 in FIG. 6, remains undamaged. In this way, the upper part 17 of the pack formed by the plastic film 1, above the line-shaped element 3, may be lifted, thus freeing the upper layer of rolls R. However, thanks to the undamaged portion 15 of plastic film 1, the upper part 17 of the pack 10 remains fastened to the remaining part, indicated with 19, of the plastic film 1 wrapped around the pack 10. The rolls arranged below the line-shaped element 3 remain wrapped in the part 19 of the pack 10.

In this way it is possible, for example, to remove one roll R and to close, at least partially, the pack using the portion 17 of the plastic film 1 like a cover hinged to the lower part 19 of the pack 10 at the portion 15

In order to prevent the plastic film 1 from being torn beyond the end 3A of the line-shaped element 3, a device or member can be applied to the plastic film 1 to avoid tearing thereof, for example an adhesive label, that can also serve as advertisement, decoration or mark for the packed product.

Also in the case the line-shaped element 3 has a longitudinal extension equal to the longitudinal dimension of the edges 1.1 and 1.2, as shown in FIG. 1, it is possible to have a similar effect by using a member for avoiding the breakage or tearing of the plastic film 1. This member may be for example a self-adhesive label, indicated with 21 in FIG. 5. Pulling the line-shaped element 3 starting from the end 3B accessible from the outside of the pack 10 along the transverse edge 1.3 results in the film 1 being torn up to the area where the label 21 is provided. The label 21 avoids any subsequent tearing.

Having described the general features of the pack, now preferred features of some embodiments will be described below.

In various embodiments of the pack, the line-shaped element may be provided with an adhesive characterized by an adhesion to steel equal to, or lower than, 400 g/25 mm measured according to the FINAT FTM1 standard.

In some embodiments, the line-shaped element is arranged along a plane orthogonal to the axes of the rolls R of the pack, the plane being spaced from one of the approximately flat opposite surfaces by a distance equal to, or lower than 40%, and preferably equal to, or lower than 30%, and more preferably equal to, or lower than 25% of the overall distance between the two approximately flat opposite surfaces.

In possible embodiments, the plastic film 1 may have a thickness comprised between 15 and 50 micrometers, preferably between 20 and 40 micrometers. In order to enhance the features of the pack, the plastic film 1 may have an anisotropic tensile strength at break with different values in the direction parallel to the line-shaped element 3 and in the direction orthogonal to the line-shaped element 3.

The plastic film 1 may have a tensile strength at break in the direction parallel to the line-shaped element 3 lower than the tensile strength at break in the direction orthogonal to the line-shaped element 3. In some embodiments, the plastic film 1 may have an elongation at break in the direction parallel to the line-shaped element 3 greater than the elongation at break in the direction orthogonal to the line-shaped element 3.

For example, the plastic film 1 may have a first tensile strength at break in the direction parallel to the line-shaped element 3 and a second tensile strength at break in the direction orthogonal to the line-shaped element 3. The ratio between the first tensile strength at break and the second tensile strength at break can be comprised between 1:1 and 1:2.5, and preferably between 1:1.05 and 1:2.3, the break strength being measured according to the ASTM D 882 standard.

Moreover, in possible embodiments, the plastic film 1 may have a first elongation at break in the direction orthogonal to the line-shaped element 3 and a second elongation at break in the direction parallel to the line-shaped element 3. The ratio between the first elongation at break and the second elongation at break may be comprised between 1:2 and 1:5.

The line-shaped element 3 may have a longitudinal elongation at break equal to, or lower than, 50%, preferably equal to, or lower than, 40%, and more preferably equal to, or lower than, 30%. The longitudinal tensile strength at break of the line-shaped element 3 is preferably greater than the longitudinal tensile strength at break of the plastic film 1. For instance, the longitudinal tensile strength at break of the line-shaped element 3 can be preferably at least three times the longitudinal tensile strength at break of the plastic film 1.

In advantageous exemplary embodiments, the tensile strength at break of the line-shaped element 3 is equal to, or greater than, 20 kg/25 mm according to the AFERA 4004 standard.

The invention claimed is:

1. A pack of tissue paper rolls, comprising:

a plurality of rolls of tissue paper arranged adjacent to one another with respective axes parallel to, or coinciding with, one another, the plurality of rolls of tissue paper being wrapped in a plastic film, wherein the plastic film laterally wraps the plurality of rolls of tissue paper and the plastic film is arranged with a first longitudinal edge and a second longitudinal edge folded and closed onto two approximately flat opposite surfaces, the two approximately flat opposite surface being defined by bases of the plurality of rolls of tissue paper, the plastic film comprising a first transverse edge and a second transverse edge extending from one of the two approximately flat opposite surfaces to another one of the two approximately flat opposite surfaces, one of the first transverse edge and the second transverse edge being outside the pack and another one of the first transverse edge and the second transverse edge being inside the pack, wherein a line-shaped element is applied to a surface of the plastic film, the line-shaped element having a first end and a second end, at least one of the first end and the second end of the line-shaped element being arranged near, or at the one of the first transverse edge and the second transverse edge of the plastic film outside the pack, wherein the line-shaped element completely surrounds the pack and a member is applied to the plastic film to prevent the plastic film from breaking, the member being applied along the line-shaped element, wherein the member extends across a portion of the line-shaped element, the plastic film comprising a first plastic film outer surface portion located on one side of the line-shaped element and a second plastic film outer surface portion located on another side of the line-shaped element, the member bridging the portion of the line-shaped element, wherein the member is in direct contact with the first plastic film outer surface portion and the second plastic film outer surface portion, wherein the member comprises a member longitudinal axis, one of the first plastic film outer surface portion and the second plastic film outer surface portion being movable about the member longitudinal axis relative to another one of the first plastic film outer surface portion and the second plastic film outer surface portion after the plastic film is torn via the line-shaped element.

2. A pack according to claim 1, wherein the line-shaped element is applied to the surface of the plastic film sheet facing the inside of the pack.

3. A pack according to claim 1, wherein the line-shaped element comprises a strip of polymer material, the member comprising a member portion, the line-shaped element comprising a line-shaped element portion, the member portion being located radially outward of the line-shaped element portion with respect to a longitudinal direction of plastic film.

4. A pack according to claim 1, wherein the line-shaped element is applied to the plastic film via glue.

5. A pack according to claim 4, wherein the line-shaped element comprises an adhesive, the adhesive comprising an adhesion to steel equal to, or less than 400 g/25 mm measured according to a FINAT FTM1 standard.

6. A pack according to claim 1, wherein the line-shaped element is arranged on a plane approximately orthogonal to the axes of the plurality of rolls oftissue paper, wherein the line-shaped element extends three-hundred-and-sixty degrees about the plurality of rolls of tissue paper.

7. A pack according to claim 6, wherein the plane where the line-shaped element is arranged is spaced from one of the approximately flat opposite surfaces by a distance equal to, or less than, 40%.

8. A pack according to claim 6, wherein the plane where the line-shaped element is arranged is spaced from one of the approximately flat opposite surfaces by a distance equal to or less than 30% of an overall distance between the two approximately flat opposite surfaces.

9. A pack according to claim 6, wherein the plane where the line-shaped element is arranged is spaced from one of the approximately flat opposite surfaces by a distance equal to or less than 25% of an overall distance between the two approximately flat opposite surfaces.

10. A pack according to claim 1, wherein a thickness of the plastic film is comprised between 15 and 50 micrometers.

11. A pack according to claim 1, wherein the plastic film has an anisotropic tensile strength at break, with different values in a direction parallel to the line-shaped element and in a direction orthogonal to the line-shaped element.

12. A pack according to claim 1, wherein the plastic film has a tensile strength at break in a direction parallel to the line-shaped element less than the tensile strength at break in a direction orthogonal to the line-shaped element.

13. A pack according to claim 1, wherein the plastic film has an elongation at break in a direction parallel to the line-shaped element greater than the elongation at break in a direction orthogonal to the line-shaped element.

14. A pack according to claim 1, wherein the plastic film has a first tensile strength at break in a direction parallel to the line-shaped element and a second tensile strength at break in a direction orthogonal to the line-shaped element, wherein a ratio between the first tensile strength at break and the second tensile strength at break is comprised between 1:1 and 1:2.5, the break strength being measured according to an ASTM D 882 standard.

15. A pack according to claim 1, wherein the plastic film has a first elongation at break in a direction orthogonal to a direction of the line-shaped element and a second elongation at break in a direction parallel to a direction of the line-shaped element, wherein a ratio between the first elongation at break and the second elongation at break is comprised between 1:2 and 1:5.

16. A pack according to claim 1, wherein a width of the line-shaped element is comprised between 1 and 3 mm.

17. A pack according to claim 1, wherein a thickness of the line-shaped element is comprised between 15 and 50 micrometers.

18. A pack according to claim 1, wherein the line-shaped element has a longitudinal elongation at break equal to, or less than, 50%.

19. A pack according to claim 1, wherein a longitudinal tensile strength at break of the line-shaped element is greater than a longitudinal tensile strength at break of the plastic film.

20. A pack according to claim 19, wherein the longitudinal tensile strength at break of the line-shaped element is at least three times the longitudinal tensile strength at break of the plastic film.

21. A pack according to claim 1, wherein a tensile strength at break of the line-shaped element is equal to, or greater than, 20 kg/25 mm according to an AFERA 4004 standard.

22. A pack according to claim 1, wherein a thickness of the plastic film is comprised between 20 and 40 micrometers.

23. A pack according to claim 1, wherein the plastic film has a first tensile strength at break in a direction parallel to the line-shaped element and a second tensile strength at break in a direction orthogonal to the line-shaped element, wherein a ratio between the first tensile strength at break and the second tensile strength at break is comprised between 1:1.1 and 1:2.3, the break strength being measured according to an ASTM D 882 standard.

24. A pack according to claim 1, wherein a thickness of the line-shaped element is comprised between 20 and 40 micrometers.

25. A pack according to claim 1, wherein the line-shaped element has a longitudinal elongation at break equal to or less than 40%.

26. A pack according to claim 1, wherein the line-shaped element has a longitudinal elongation at break equal to or less than 30%.

* * * * *